United States Patent [19]

Stoller

[11] 4,113,827

[45] Sep. 12, 1978

[54] METHOD AND APPARATUS USEFUL IN CONTROL OF EDGE UNIFORMITY IN NONWOVEN FABRICS

[75] Inventor: Frederick L. Stoller, Greenville, S.C.

[73] Assignee: Phillips Petroleum Company, Bartlesville, Okla.

[21] Appl. No.: 723,394

[22] Filed: Sep. 15, 1976

[51] Int. Cl.[2] ..... B29C 15/00

[52] U.S. Cl. ..... 264/280; 264/296

[58] Field of Search ..... 264/280, 284, 118, 119, 264/296

[56] References Cited

U.S. PATENT DOCUMENTS

| | | | |
|---|---|---|---|
| 2,165,280 | 7/1939 | Lannan | 264/119 X |
| 2,591,385 | 4/1952 | Sunderhauf | 264/284 X |
| 2,700,177 | 1/1955 | Mottet | 264/118 |
| 2,744,848 | 5/1956 | Mottet | 264/119 X |
| 2,891,279 | 6/1959 | Neumann | 264/327 X |
| 2,922,190 | 1/1960 | Higgins | 264/280 |
| 3,103,410 | 9/1963 | Dobbins | 264/280 |

*Primary Examiner*—Thomas P. Pavelko

[57] ABSTRACT

A nonwoven fabric is passed to a compression zone wherein the edge portions of said fabric are compressed to produce a nonwoven fabric with a uniform thickness.

8 Claims, 3 Drawing Figures

METHOD AND APPARATUS USEFUL IN CONTROL OF EDGE UNIFORMITY IN NONWOVEN FABRICS

BACKGROUND

The invention relates to a method suitable to produce a nonwoven fabric with a uniform thickness. Further the invention relates to apparatus suitable to carry out the method.

Nonwoven fabrics produced employing various staple fibers such as for example polypropylene, nylon, polyvinylchloride, cotton, wool, etc. are well known in the art. Various methods are known to produce such nonwoven fabrics from staple fibers. One method commonly employed involves forming a nonwoven fabric by crosslapping carded webs of staple fibers using crosslappers, passing the nonwoven fabric formed from the crosslapped carded webs to one or more needle looms to needle punch the nonwoven fabric which forces filaments in the various webs into one another thus bonding the webs together to provide integrity to the fabric. Such nonwoven fabrics when fused on one or both sides are useful for such products as carpet backing, upholstery stretching strips, mattress ticking, etc.

A relatively new use for such nonwoven fabrics which are generally unfused is for backing polymeric films to produce unholstery material as is known in the art. Although the use of such upholstery material has been accepted in the industry with considerable success, there is a problem in cutting the material into patterns. This problem involves the lack of uniformity in thickness of such crosslapped nonwoven fabrics because the crosslapping of the webs causes the edge portions of such fabrics to be thicker than the middle portion of the fabric. The nonwoven fabric is generally produced by the manufacturer in widths of approximately 15 feet. Since the upholstery industry generally manufactures upholstery goods in widths substantially less than 15 feet, such as approximately 4 feet, 6 inches, the nonwoven fabric with a width of 15 feet is cut into three 5 foot widths by the nonwoven fabric manufacturer, and then trimmed to 4 feet, 6 inches by the upholstery goods manufacturer. thus, two of the three 5 foot widths of fabric have one edge thicker than the other. The 5 foot width nonwoven fabric is then coated with a polymeric material generally employing the direct calender lamination or the post lamination technique known in the art to produce the nonwoven backed upholstery material. As noted above it is common for the upholstery industry to cut such upholstery material into patterns. It is also common to cut a number of pieces of the material at the same time by cutting stacks of the material, that is, cutting several pieces of the material which are stacked one above the other. A problem arises when cutting stacks of the material because the two 4 foot, 6 inch width pieces made from the 5 foot width outside edge pieces of the 15 foot width material do not have a uniform thickness. When the nonwoven backed upholstery material is stacked for cutting the nonuniformity of the nonwoven backing material is magnified which results in poor pattern definition. The present invention provides a method and apparatus useful for producing a nonwoven fabric with a uniform thickness which results in the elimination of the above-described cutting problems when such fabric is used as the backing in the upholstery material.

An object of the invention is to produce a nonwoven fabric with a uniform thickness.

Another object of the invention is to reduce the thickness of the edges of a nonwoven fabric formed by crosslapping webs.

Another object of the invention is to provide apparatus suitable for the production of a nonwoven fabric having a uniform thickness.

Other objects, advantages, and aspects of the invention will be apparent to those skilled in the art after studying the specification and the appended claims.

According to the present invention a nonwoven fabric having thickened edge portions is passed through a compression zone wherein the edge portions of the fabric are compressed to produce a nonwoven fabric with a uniform thickness. It is generally desirable to pass the fabric to the compression zone as the fabric is being produced.

Further according to the invention apparatus comprises a first roll with a fixed axis; a second roll with a movable axis, the axis of the second roll positioned adjacent and approximately parallel to the first roll to form a nip with the first roll; two bearings each mounted on a slidable support one for supporting one end and one for supporting the other end of the axis of the second roll; and two means, one attached to one of the supports and one attached to the other, the means for positioning each end of the axis of the second roll in a direction normal to the axis of the first roll.

DETAILED DESCRIPTION OF THE INVENTION

Figure 3:
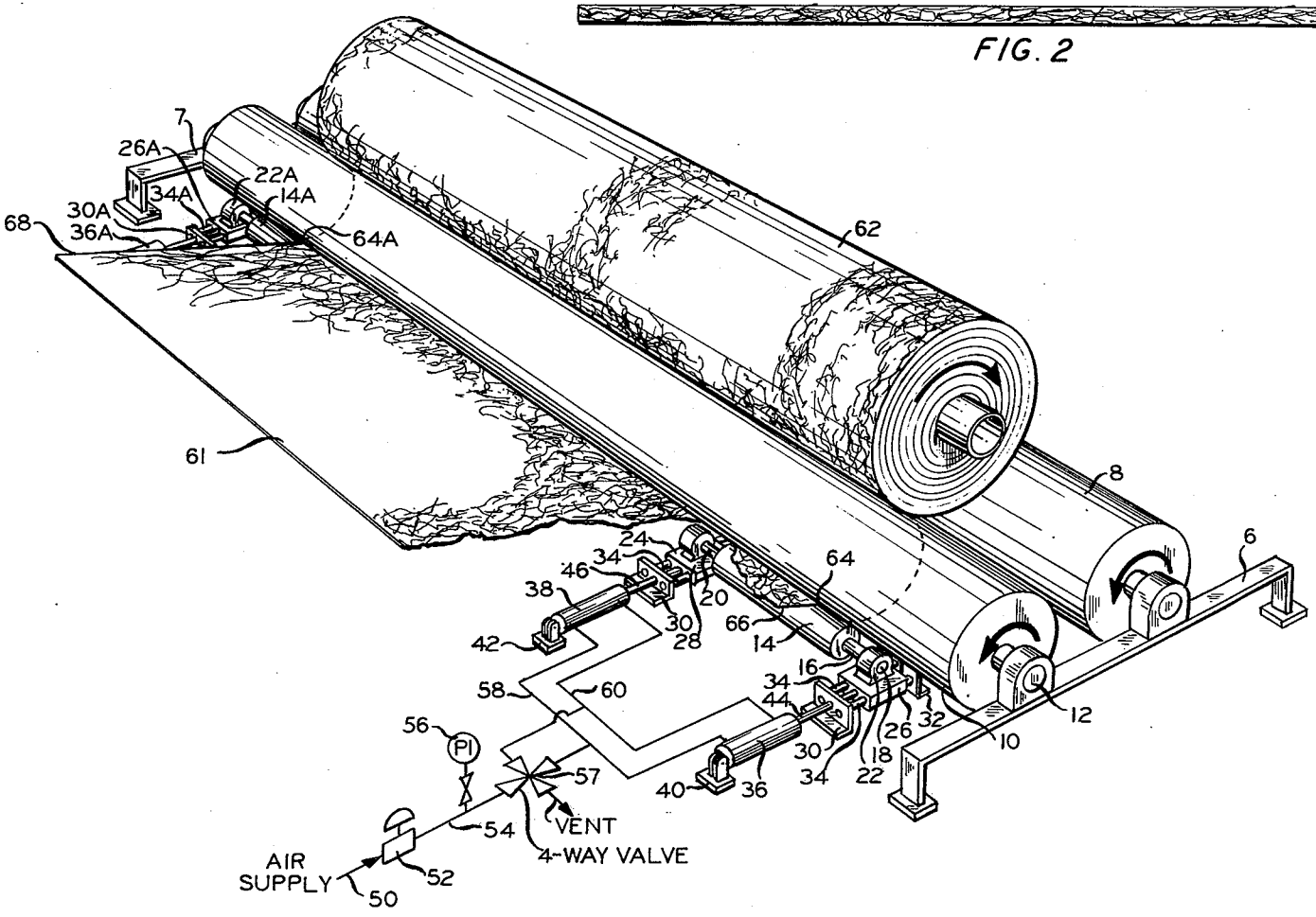
FIG. 3 is a pictorial view of one embodiment of the apparatus of the present invention used for treatment of a nonwoven fabric prior to rolling up the fabric.

Referring to FIG. 3 one embodiment of the apparatus of the invention is shown in which a first roll 10 having a fixed axis 12 and rotating in the direction shown by the arrow forms a nip 64 with a second roll 14 having a movable axis 16 with ends 18 and 20 mounted in bearing blocks 22 and 24, respectively. Bearing block 22 is mounted on slidable support 26 and bearing block 24 is mounted on slidable support 28. Slidable supports 26 and 28 each comprise stationary pieces 30 and 32 with two fixed rods 34 passing through the respective slidable supports and attached to the stationary pieces. Each slidable support 26, 28 are attached to a means for moving the slidable support and thus moving each end of the axis of roll 14. As shown in the drawings, said means comprises two air cylinders 36 and 38 having a stationary end 40 and 42, respectively, and plungers 44 and 46. Plunger 44 passes through stationary piece 30 and is attached to slidable support 26 and plunger 46 passes through another stationary support 30 and is attached to slidable support 28. Air is supplied via line 50 to a regulator 52 then through line 54 to a four-way valve 57 with one line 58 connected to air cylinders 36 and 38 near the fixed end and line 60 connected near the plunger end of said air cylinders. Roll 8 positioned parallel and adjacent to roll 10 is supported by frame members 6 and 7 which also support roll 10. Rolls 8 and 10 form a cradle which holds the roll of nonwoven fabric as it is being wound. Roll 8 and/or 10 are driven in the direction of the arrows by a suitable power means (not shown). The rotation of rolls 8 and 10 cause nonwoven fabric 61 to form the roll 62 of nonwoven fabric.

In the embodiment of the invention shown in FIG. 3 an additional roll 14A is provided in which a nip 64A is formed between roll 10 and roll 14A comparable to nip 64 formed between roll 10 and roll 14. Also, roll 14A is equipped identically to roll 14 with two air cylinders, two bearings, two slidable supports, air lines, four-way valve, and other associated equipment although only a portion of said equipment is shown in the drawing.

Figure 1:
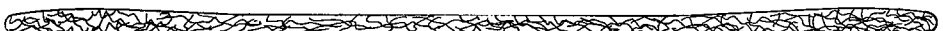
FIG. 1 shows a schematic representation of the cross section of the width of a nonwoven fabric before being processed in accordance with the invention.
Figure 2:
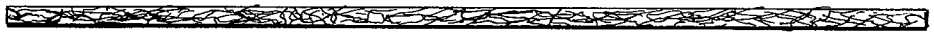
FIG. 2 shows the cross section of the width of a nonwoven fabric of FIG. 1 after being processed in accordance with the invention.

In the operation of the invention as shown in the embodiment of FIG. 3 a nonwoven fabric passes under roll 10 and between rolls 8 and 10. The rotation of rolls 8 and 10 in a counterclockwise direction rolls the nonwoven fabric into roll 62 which rotates in a clockwise direction. Edge 66 of nonwoven fabric 61 passes between nip 64 formed between roll 10 and roll 14 and edge 68 of nonwoven fabric 61 passes between nip 64A formed between roll 10 and roll 14A. Air pressure is supplied to air cylinders through air supply line 50, regulator 52, line 54, four-way valve 57 and line 58 to force roll 14 against roll 10 and to compress edge 66 of nonwoven fabric 61. In a like manner roll 14A is forced against roll 10 to compress edge 68 of nonwoven fabric 61. The nonwoven fabric shown in FIG. 1 is schematically representative of nonwoven fabric 61 prior to passing through nips 64 and 64A and FIG. 2 represents a cross section of the width of said nonwoven fabric 61 after passing through said nips and illustrates how the compression of the edge portions 66, 68 of the fabric 61 provide a uniform thickness across the fabric. When the uniform fabric of FIG. 2 is used as a backing for polymeric film such as polyvinyl chloride it can be stacked for pattern cutting with good pattern definition.

Four-way valve 57 is used to apply air pressure either to the stationary end of air cylinders 36 and 38 via line 58 and thus to force roll 14 against roll 10 or to supply air pressure to air cylinders 36 and 38 via line 60 near the plunger end of said cylinders thus to move roll 14 away from roll 10. Regulator 52 is used to adjust the air pressure in either lines 58 or line 60 to the desired pressure as indicated on pressure gauge 56 which accordingly controls the pressure of roll 14 against roll 10. Of course the operation of roll 14A is identical to roll 14. Also both roll 14 and roll 14A can be operated by the same four-way valve if desired simply by connecting line 58 to the stationary end of all four air cylinders and connecting line 60 to the plunger end of all four air cylinders.

The pressure on the fabric between the nip of rolls 14 and 10 and 14A and 10 can be selected over a relatively wide range which depends to some degree upon the weight of the nonwoven material. Generally the pressure ranges from about 25 to about 80 pounds per lineal inch of the roll with the movable axis such as rolls 14 and 14A of FIG. 3. The lower end of the above range is generally employed for lighter weight nonwoven fabrics and the higher end of the above range is generally employed for the heavier weight nonwoven fabrics. For the heavier weight fabrics, those ranging from about 3.5 to about 6 ounces per square yard, a pressure ranging from about 60 to about 80 pounds per lineal inch is employed. For light weight fabric, those ranging from about 1.5 to about 3.5 ounces per square yard, a pressure is generally employed ranging from about 25 to about 60 pounds per lineal inch.

Although the embodiment in FIG. 3 shows that roll 10 provides a dual function in that it functions to form the cradle for roll 62 of nonwoven fabric along with roll 8, and roll 10 also is used as the stationary or fixed roll for use with movable rolls 14 and 14A to form nips 64 and 64A, respectively, it is understood that one can practice the present invention by using independent stationary or fixed rolls with movable rolls 14 and 14A completely independent of roll 10. Further it is understood that a stationary roll for use with rolls 14 and 14A other than roll 10 can be one roll on a single axis serving as the fixed roll for both rolls 14 and 14A, in the same manner as roll 10 in FIG. 3, or that two stationary or fixed rolls for use with rolls 14 and 14A respectively, can be used which are also independent and completely separate from roll 10 and from one another. Rolls 14 and 14A should be of a sufficient length to compress the nonuniformities caused by the crosslapper, for example, a roll 18 inches long (45.7 cm), 5 inch diameter (12.7 cm) was used for a 15 foot wide (4.57 meters) fabric.

While invention has been described in relation to 15 foot wide (4.57 meters) fabric, it can be applied to narrower or wider fabrics which may require longer or shorter rolls 14 and 14A depending on the nonuniformities caused by the crosslapper.

The diameter of the fixed roll and the movable roll, as well as the materials used on the surface of the rolls used in accordance with the present invention have not been found to be particularly critical. Either the stationary or movable rolls can have surfaces of steel, rubber, plastic, or any combinations thereof, which may be desirable. Good results have been obtained employing roll 10 with a steel surface and rolls 14 and 14A with a steel surface as indicated in the example described below.

EXAMPLE

A nonwoven fabric was constructed from 3 denier polypropylene staple fibers 3.25 inches long (8.25 cm) by carding the fibers to form a narrow web which was then laid on a floor apron by crosslapping the web to form a batt 15 feet (4.57 meters) wide. The batt was needle punched to consolidate the batt and then passed between the nip of a fixed axis steel surfaced roll, 12.75 inch diameter (32.32 cm), similar to roll 10 of FIG. 3 and two movable axis steel rolls 18 inches long (45.7 cm), 5 inch (12.7 cm) in diameter, similar to rolls 14 and 14A of FIG. 3 positioned at each end of the fixed axis roll and held at a pressure of 70 lbs./lineal inch of the 18 inch rolls against the fabric to produce an unfused nonwoven fabric, 4.1 ounces (127.5 grams) per square yard which had a uniform thickness. The material was then cut to produce three 5 foot width (1.5 meter) pieces.

What is claimed is:

1. A method comprising:

passing a nonwoven fabric to a compression zone, said fabric being produced from staple fibers and having two edge portions and a middle portion wherein the edge portions are thicker portions of said fabric as compared to said middle portion, and compressing only the thicker portions in the compression zone to reduce the thickness of said thicker portions approximately to the thickness of said middle portion so that a nonwoven fabric with a uniform thickness is produced.

2. The method of claim 1 wherein the nonwoven fabric is produced by crosslapping webs.

3. The method of claim 1 wherein the nonwoven fabric comprises polypropylene staple.

4. The method of claim 1 wherein said compression zone comprises a nip through which each thicker portion passes wherein each nip is formed by a first roll and a second roll positioned parallel and adjacent to said first roll.

5. The method of claim 4 wherein the compression pressures exerted on each thicker portion of said fabric in each nip is manually adjusted to produce said nonwoven fabric with said uniform thickness.

6. The method of claim 5 wherein the nonwoven fabric has a weight ranging from about 3.5 to 6 ounces per square yard and the compression pressure ranges from about 60 to about 80 pounds per lineal inch of the compression zone.

7. The method of claim 5 wherein the nonwoven fabric has a weight ranging from about 1.5 to 3.5 ounces per square yard and the compression pressure ranges from about 25 to about 60 pounds per lineal inch of the compression zone.

8. The method of claim 5 wherein the nonwoven fabric has a weight of about 4.1 ounces per square yard and the compression pressure is about 70 pounds per lineal inch of the compression zone.

* * * * *